United States Patent [19]

Scagnelli

[11] 4,137,621

[45] Feb. 6, 1979

[54] APPARATUS AND METHOD OF APPLYING STAPLE-LIKE BOTTOM STOPS TO SLIDE FASTENERS AND THE LIKE

[75] Inventor: George J. Scagnelli, Meadville, Pa.

[73] Assignee: Textron, Inc., Providence, R.I.

[21] Appl. No.: 827,699

[22] Filed: Aug. 25, 1977

[51] Int. Cl.[2] ..... B29D 5/00

[52] U.S. Cl. ..... 29/408; 29/33.2; 29/767; 29/768

[58] Field of Search ..... 29/408, 766, 33.2, 409, 29/767, 768, 798, 809, 811, 816; 227/18, 149

[56] References Cited

U.S. PATENT DOCUMENTS

| | | | |
|---|---|---|---|
| 1,726,012 | 8/1929 | Bilz | 227/149 X |
| 2,240,455 | 4/1941 | Carlile | 227/95 |
| 2,631,638 | 3/1953 | Levine | 29/767 |
| 2,972,150 | 2/1961 | Wegrzyn | 29/33.2 |
| 3,065,470 | 11/1962 | Schmidt | 227/115 |
| 3,357,619 | 12/1967 | Faure | 227/149 |
| 3,789,486 | 2/1974 | Douri | 29/767 |

*Primary Examiner*—Victor A. DiPalma
*Attorney, Agent, or Firm*—O'Brien and Marks

[57] ABSTRACT

A split carrier for receiving bottom stops from a feeding chute is biased toward a raised position beneath a ram which upon downward movement forces the bottom stop and carrier downward where the forces of wing portions of the bottom stop engaging camming seating edges on respective halves of the carrier force the carrier halves apart and install the bottom stop on the slide fastener.

7 Claims, 14 Drawing Figures

APPARATUS AND METHOD OF APPLYING STAPLE-LIKE BOTTOM STOPS TO SLIDE FASTENERS AND THE LIKE

BACKGROUND OF THE INVENTION

1. Field of the Invention

This invention relates to the installation of staple-like bottom stops on slide fasteners.

2. Description of the Prior Art

The prior art, as exemplified in U.S. Pat. No. 2,240,455, No. 2,972,150, No. 3,065,470 and No. 3,084,344 contains a number of machines for applying bottom stops or staples to garments or slide fasteners. The prior art machines generally have one or more deficiencies such as not operating reliably, being excessively large or complex, being expensive to manufacture, etc.

SUMMARY OF THE INVENTION

The invention is summarized in an apparatus for applying bottom stops having upper wing portions and downward extending prongs to a slide fastener including a support, a split carrier having carrier halves and a central vertical opening formed between the carrier halves, means mounting the split carrier on the support for allowing sliding movement of the carrier upward and downward, means biasing the carrier to a raised position, means for feeding the bottom stops sequentially to the carrier at the raised position, said carrier having downward coverging camming surfaces at the top edges of the opening in the respective carrier halves for seating the respective upper wings of a bottom stop, means biasing the carrier halves together with a force greater than outward forces generated by the wing portions of a bottom stop on the camming surfaces of the carrier halves resulting from the upward bias of the carrier, a ram aligned with the central opening in the carrier, an anvil mounted on the support beneath the carrier and the ram and having means for crimping the prongs of the bottom stop, and means mounting the ram on the support for moving the ram upward and downward such that during downward movement the ram engages the top of the bottom stop, moves the bottom stop and the carrier simultaneously down to a slide fastener positioned on the anvil, pushes the bottom stop between the carrier halves, and forces the prongs of the bottom stop through the slide fastener and against the crimping means of the anvil to crimp the prongs and secure the bottom stop to the slide fastener.

An object of the invention is to provide new and improved techniques for installing bottom stops or staples in slide fasteners reducing failures and utilizing simplified inexpensive machines.

Another object of the invention is to utilize an independently supported carrier for receiving and guiding a staple bottom stop from a raised position to a lowered position under the force of a ram installing the staple.

It is also an object of the invention to provide a combination of upward bias, cam seating surfaces and inward bias on a split carrier to simplify the handling and installation of staple bottom stops.

One advantage of the invention is that separate upward bias of a carrier permits a more simple and inexpensive staple setting machine.

Another advantage of the invention is that the inward bias on the carrier halves is set at a careful precise level to provide support and guidance of the staples until engagement with the slide fasteners.

An additional feature of the invention concerns the capability of holding the carrier out of engagement with garment portions which could be damaged by such engagement A still further feature of the invention utilizes the spinning of a barrel for advancing sliders into a channel and thus into a chute leading to a feeding station.

Other objects, advantages and features of the invention will be apparent from the following description of the preferred embodiment taken in conjunction with the accompanying drawings.

DESCRIPTION OF THE PREFERRED EMBODIMENTS

Figure 2:
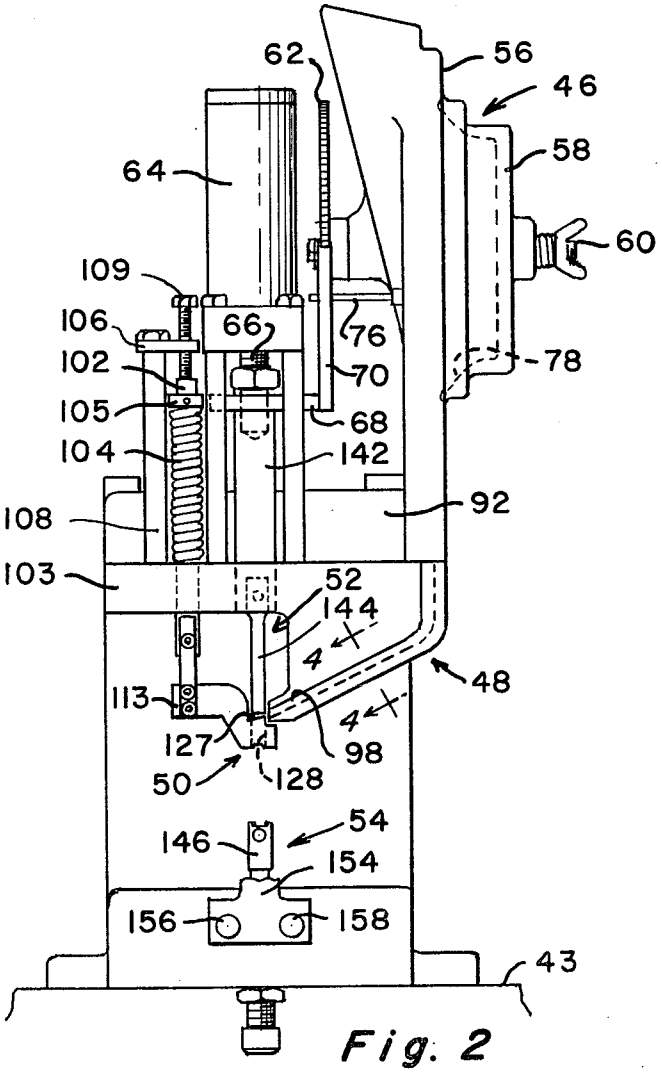
FIG. 2 is a front view of the apparatus of FIG. 1.
Figure 1:
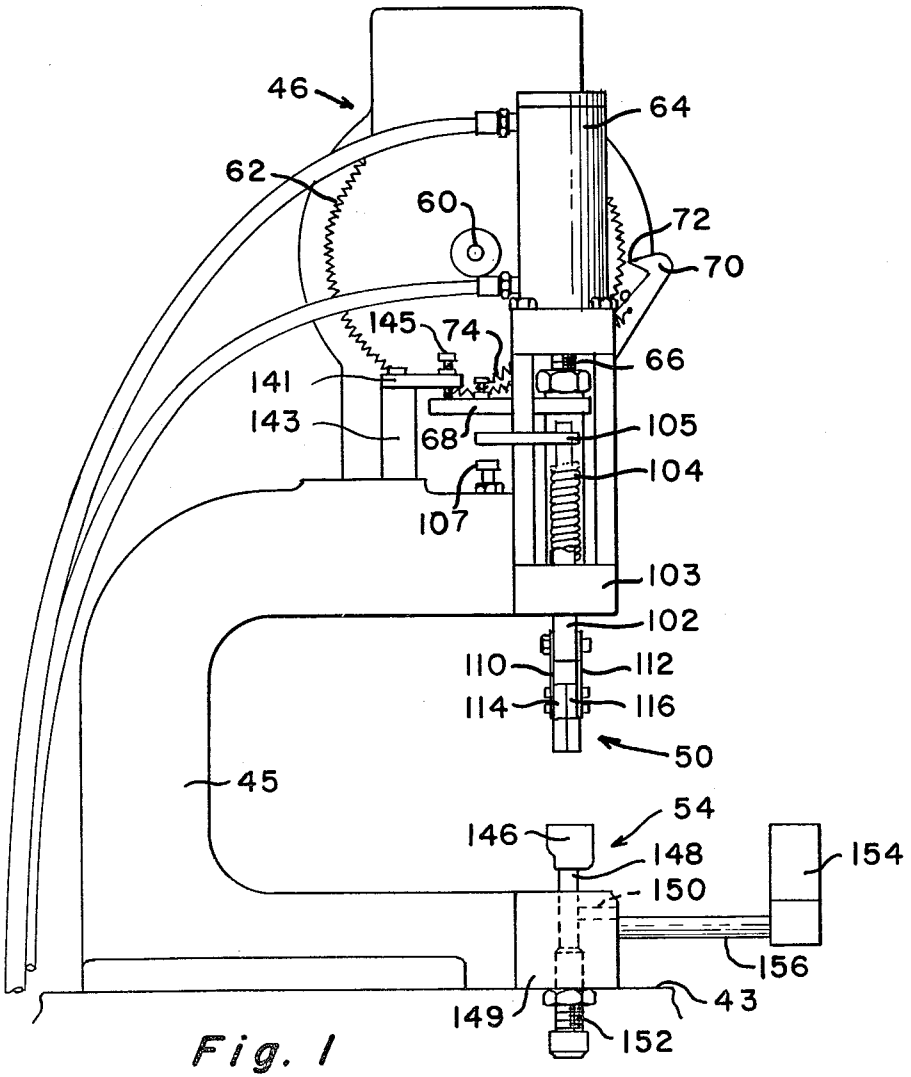
FIG. 1 is a side elevation view taken from the right side with portions broken away of an apparatus for installing staple-like bottom stops on a slide fastener in accordance with the invention.
Figure 3:
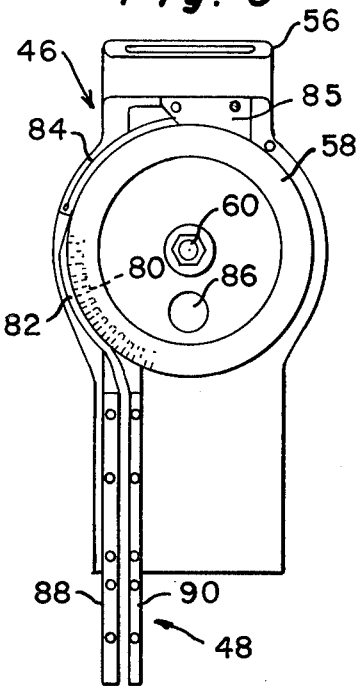
FIG. 3 is a side view taken from the right side of an upper portion of the apparatus of FIGS. 1 and 2.
Figure 8:
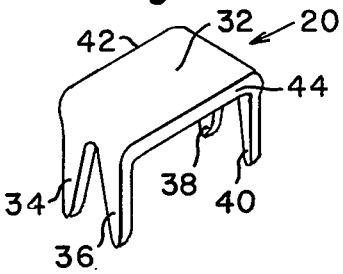
FIG. 8 is a perspective view of a staple-like bottom stop for installation by the apparatus of FIGS. 1–7.
Figure 9:
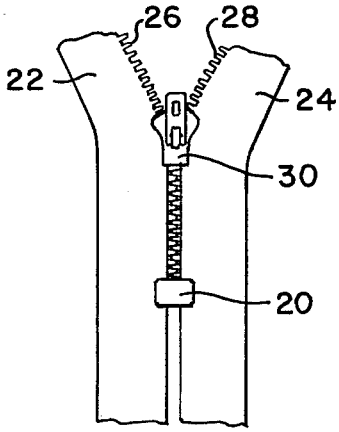
FIG. 9 is a plan view of a slide fastener with the bottom stop of FIG. 8 applied thereto in accordance with the invention.
Figure 10:
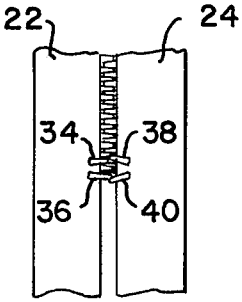
FIG. 10 is a bottom view of a portion of the slide fastener of FIG. 9.

The invention is embodied in an apparatus shown in FIGS. 1–3 for installing staple-like bottom stops 20, FIG. 8, on slide fasteners, FIGS. 9 and 10. Such slide fasteners include a pair of carrier tapes 22 and 24 with trains of interlocking coupling elements 26 and 28 attached to the inner edges thereof and with a slider 30 slideably mounted on the coupling elements 26 and 28 for opening and closing the slide fastener. The tapes 22 and 24 of the slide fastener may be sewn to portions of a garment (not shown) on opposite sides of an opening in the garment. The staple-like fastening elements 20 each has a top 32 with a plurality of prongs, for example four prongs 34, 36, 38 and 40, extending from respective opposite sides of the staple 20. The top portion 32 has wing portions 42 and 44 which extend outward therefrom. As shown in FIG. 10 the prongs 34, 36, 38 and 40 are forced through the respective carrier tapes 22 and 24 and crimped over on one side of the tape to secure the lower ends of the tapes 22 and 24 and the trains 26 and 28 together as well as to form a stop for downward movment of the slider 30.

Referring back to FIG. 1 the apparatus for securing the bottom stops 20 to the slide fasteners includes a cast frame or support 45 mounted on a table-top 43 supporting a dispensing or hopper means indicated generally at 46, a chute indicated generally at 48, a split carrier indicated generally at 50, a ram or punch means indicated generally at 52, and an anvil means indicated generally at 54.

The dispensing means 46, as shown in FIGS. 1, 2 and 3 includes a cast hopper body 56 which is open at the top for receiving a plurality of the staples 20, and has an opening on one side closed by a barrel member 58 mounted on one end of a shaft 60 rotatably extending through suitable bearing means in the hopper body 56. A gear 62 is mounted on the other end of the shaft 60. A double acting air cylinder 64 for operating the ram means 52 is suitably mounted by four posts on the support 45 and has a piston rod 66 to which is attached an arm 68. The air cylinder 64 is controlled by a conventional means such as a foot pedal valve or switch controlling a valve (neither shown). A pawl 70 having a pointed projection 72 at its upper end is pivotally attached at its lower end to one side of the arm 68 and is biased by a tension spring 74 to urge the projection 72 on the upper end thereof toward engagement with the teeth of the gear 62. A pawl release pin 76 is mounted in the side of the hopper body 56 and extends into the path of the pawl 70 so as to force the pawl 70 away from the teeth of the gear 62 when the piston rod 66 retracts to its raised position. The pin 76 can be bent or otherwise adjusted so that the gear 62 can freely rotate after disengagement of the point 72 of the pawl 70 from the teeth of the gear 62. The barrel 58 has an inner frusto-conical surface 78 in which are formed pairs of grooves 80, FIG. 3, extending radially from the axis of the barrel. Each of the pairs of the grooves 80 has a spacing and depth designed to receive respective pairs of the prongs 34, 36, 38 and 40 of the bottom stop 20. A channel 82 is cut into the side of the hopper body 56 extending back of the barrel 58 and has a suitable shape to receive bottom stops 20 thrown by centrifugal force from the grooves 80. A wiper spring 84 is attached to the hopper and extends over the top of the channel 82 and in back of a plate 85 for wiping excess elements back into the hopper from the revolving barrel 58. The channel 82 is shaped so as to feed staples 20 only with a predetermined orientation into the chute 48. Extra staples and incorrectly oriented staples are returned to the bottom of the hopper. A window 86 is installed in the front of the barrel 58 for observing the quantity of staples within the hopper; such staples would normally be less than halfway up the window 86 when the window is in the lower position as shown in FIG. 3 so as not to interfere with free spinning of the barrel 58.

Figure 4:
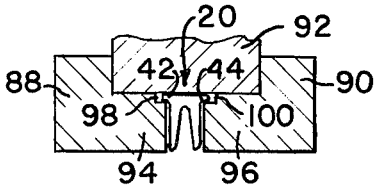
FIG. 4 is a cross sectional view taken at line 4—4 in FIG. 2 of a chute portion of the apparatus.

The chute 48 extends down from the hopper 56 to the carrier means 50 and includes as shown in FIG. 4, a pair of spaced members 88 and 90 which are suitably attached to a chute support 92 mounted on the frame 45 with inward extending lips 94 and 96 forming a channel for receiving the bottom stops 20. The channel has a width to permit the prongs of the bottom stops 20 to pass freely therethrough. Grooves 98 and 100 are formed in the upper corners of the lips 94 and 96 for receiving the wings 42 and 44 of the staples 20 to guide the staples 20 in a predetermined orientation.

Figure 5:
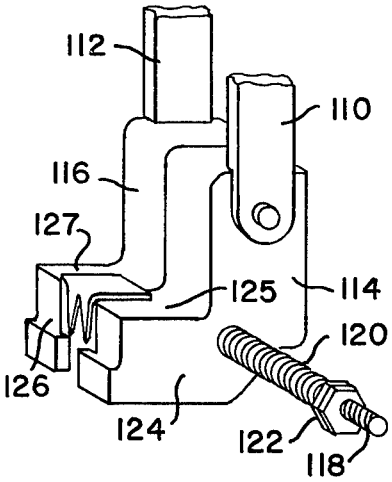
FIG. 5 is a perspective view of a split carrier broken away from the apparatus of FIGS. 1 and 2.
Figure 6:
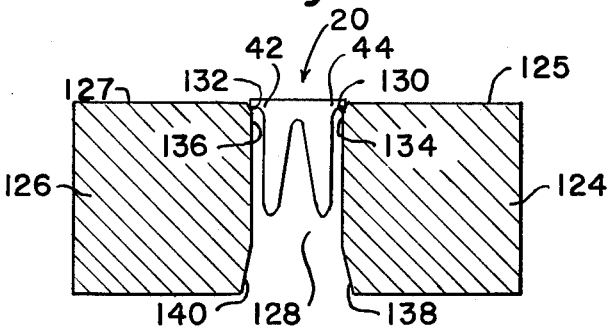
FIG. 6 is a cross sectional view of a lower portion of the split carrier of FIG. 5.
Figure 7:
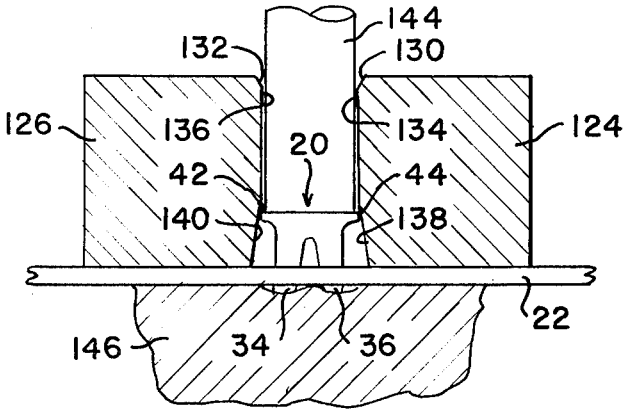
FIG. 7 is a cross sectional view similar to FIG. 6 but showing the cooperation of a ram and an anvil with the split carrier in attaching a staple-like bottom stop to a slide fastener.

As illustrated in FIGS. 1 and 2, the carrier means 50 includes a square shaft 102 slideably mounted with a support block 103 suitably attached to the frame 45. The upper portion of shaft 102 is surrounded by a compression spring 104 between the top of the block 103 and the bottom of a member such as a plate or arm 105 secured near the top end of the shaft 102 for biasing the shaft 102 upward. A set screw 107 is mounted in the frame 45 beneath the arm 105 and has an adjustment to determine the maximum lowered position of the arm 105; for fine garments the set screw 107 is used to hold the carrier means 50 out of engagement with such fine garments, but for denims or other course materials, the set screw 107 may be eliminated. An arm 106 mounted on the top of a post 108 secured to the frame 45 extends over the top of the shaft 102 and has a set screw 109 for engaging the top of the shaft 102 to set the raised position of the shaft 102 or the raised position of the carrier means 50 relative to the chute 48; this position is set to provide proper feeding of the staples into the carrier means 50. A pair of spring arms 110 and 112 are mounted on the bottom of the shaft 102. Each of the spring arms 110 and 112 support respective halves or members 114 and 116 of a carrier 113. As shown in FIG. 5 a pin or stud 118 is secured to the carrier half 116 and extends freely through a bore through the carrier half 114 with a compression spring 120 around the pin 118 between the member 114 and a pair of lock nuts 142 on the end of the pin 118 to bias the carrier halves 114 and 116 inward or together. The carrier halves 114 and 116 have extending portions 124 and 126 which are shown in FIG. 2 have upper surfaces 125 and 127 aligned with the channels 98 and 100 in the chute 48. An opening 128 illustrated in FIG. 6 is formed between the carrier portions 124 and 126. Upper corners of the carrier portions 124 and 126 have surfaces 130 and 132 which are angled from the top surfaces 125 and 127 downwardly and inwardly or converge so as to form a seat upon which wings 42 and 44 of the staples 20 rest. The angle of the surfaces 130 and 132 is selected to be at about 30° to the vertical so as to form camming surfaces for coacting with the wings 42 and 44 of the bottom 20. Below the surfaces 130 and 132 surface portions 134 and 136 are vertical while still lower surfaces 138 and 140 are relieved to angle downwardly and outwardly to diverge to increase the size of the bottom portion of the opening 128 sufficiently to avoid interfering with the crimping and the bending of the staple 20 during installation. The vertical surfaces 134 and 136 extend down to just less than the length of the staples 20 so as to guide and frictionally hold the staples 20 during movement from the seat formed by surfaces 130 and 132 until the prongs of the staples penetrate the slide fastener tapes.

In the ram means 52 in FIG. 2, a shaft 142 is mounted on the bottom end of the piston rod 66 and extends downward passing through a suitable guide opening in the support block 103. A ram or punch 144 is secured in the bottom end of the shaft 142 and extends above the carrier 113 in alignment with the opening 128 through the carrier 113. A stationary arm 141, FIG. 1, mounted by a post 143 on the frame 45 extends above the arm 68 and has a set screw 145 extending downward to engage the arm 68 in its upper position to set the raised position of the arm 144 just above the carrier 113 so as to permit feeding of a staple from the chute 48 onto the carrier 113.

In the anvil means 54 as shown in FIGS. 1 and 2 includes an anvil 146 mounted on a shaft 148 which extends within a bore in a block 149 mounted on the front face of the lower portion of the frame 45. A screw 152 is threaded into the bottom of the block 149 to abut the shaft 148 and set the height of the anvil while a set screw 150 is provided to secure and lock the shaft 148 and anvil 146 in a set position.

The anvil 146 has a top surface with a groove for receiving the interlocked coupling elements of the slide fastener and additionally has suitably formed recesses for bending the prongs of the staple 20 inwardly in a manner well known in the art.

A guide member 154 for the slide fastener or a garment containing a slide fastener is mounted on shafts 156 and 158 suitably secured to the block 149. The guide member 150 extends forward from the stapling apparatus in alignment with the anvil 146.

In operation, an initial quantity of staples 20 are placed within the hopper 56. The barrel 58 is rotated clockwise which results in some of the staples in the hopper 56 having their prongs drop into the grooves 80 then being centrifugally forced outwardly and into the channel 82 whereupon the staples drop into the chute 48 with the wing portions 42 and 44 of the staples 20 engaged within the grooves 98 and 100 formed behind the chute members 88 and 90. The staples 20 feed under the force of gravity down to the bottom end of the chute 48 where the bottom most staple is forced by the weight of the staples in the chute onto the carrier 113. The wings 42 and 44 of the staple engage the surfaces 130 and 132 to rest within a seat formed thereby with the prongs of the staple 20 extending down into the opening 128.

An operator positions a slide fastener beneath the carrier 113 over the top of the anvil 146 and actuates the air cylinder 74 causing the piston rod 66, shaft 142 and ram 144 to move downward. The bottom of the ram 144 engages the top 32 of the staple 20. Since the bias by the spring 120 secures the carrier halves 114 and 116 together with a bias greater than the outward forces generated by the camming of the wings 42 and 44 on the surfaces 130 and 132, the downward movement of the ram pushes the staple 20 and the carrier 113 down against the upward bias of the spring 104. When the carrier 113 reaches the lowermost position either where the arm 105 engages the stop 107 or where the carrier 113 engages the slide fastener, continued movement of the ram 44 pushes the staple 20 downward with respect to the carrier 113 causing the carrier halves 114 and 116 to be cammed apart by the wing portions 42 and 44 acting on the camming surfaces 130 and 132. The staple 20 is pushed downward between the vertical surfaces 134 and 136; the frictional resistance serving to hold the staple 20 in proper orientation until the prongs 34, 36, 38, and 40 penetrate the tapes 22 and 24 of the slide fastener. Continued downward movement of the ram 144 forces the prongs 34, 36, 38 and 40 against the crimping recesses formed in the anvil 146 to crimp or bend the prongs 34, 36, 38 and 40 on the lower side of the slide fastener. During the crimping of the prongs the bottom stop 20 is positioned between the relieved surfaces 138 and 140 at the lower end of the opening; the wider area formed by the surfaces 138 and 140 permit the staple 20 to be slightly twisted or distorted during the crimping without being wedged between the carrier halves 124 and 126. After completion of the installation, the ram 144 is moved upward by the return of the air cylinder. The carrier 113 is raised by the bias of the spring 104 to its raised position in position to receive another staple.

When the ram 144 is below its uppermost position during installation of a staple, the ram 144 blocks the exit from the chute 48 to hold the staples in the chute. Once the ram 144 has reached its raised position, another staple 20 is fed onto the carrier 113.

During the retraction of the piston rod 66, the pointed tip 72 of the pawl 70 engages the teeth of the gear 62 to initiate rotation of the barrel. When the piston rod 66 approaches its raised position, the pawl 70 engages the pawl release pin 76 to force the tip 72 out of engagement with the gear 62. The momentum of the barrel 58 results in the barrel continuing to spin after the piston rod 66 has reached its raised position. During spinning of the barrel 58, staples are centrifugally forced outward in the grooves 80, some of the staples being thrown into the channel 82 with proper orientation to fall into the chute 48. The other staples are returned to the bottom of the hopper.

Figure 11:
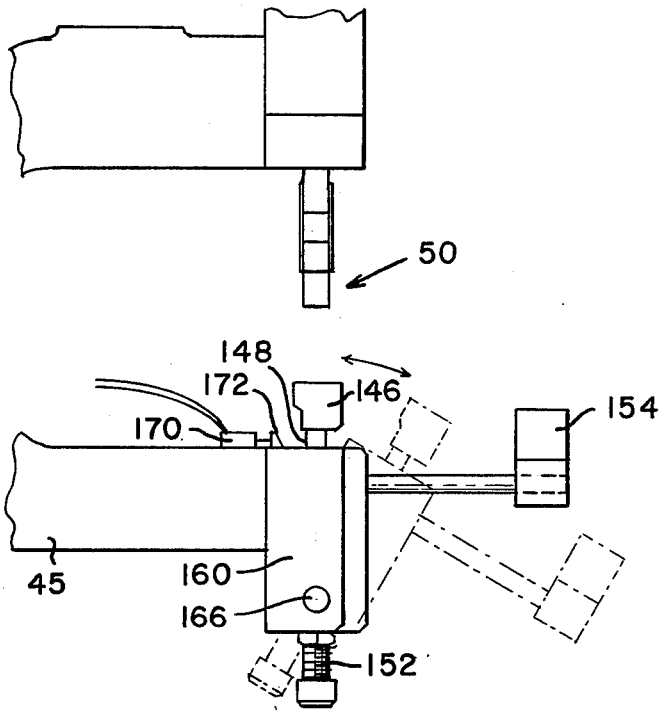
FIG. 11 is a side elevation view similar to FIG. 1 of a lower portion of a modified apparatus for installing staple-like slide fastener bottom stops in accordance with the invention.
Figure 12:
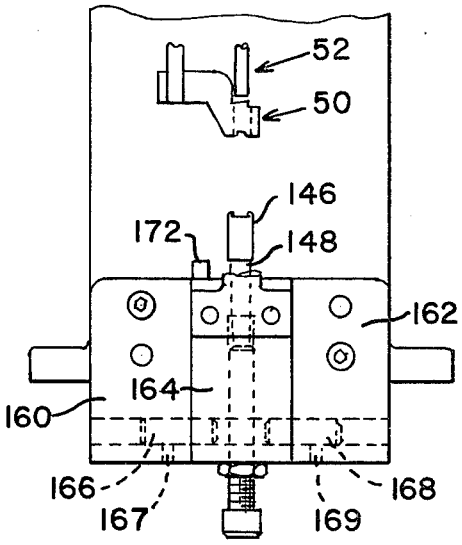
FIG. 12 is a front view of the apparatus portion of FIG. 11.

In FIGS. 11 and 12 there is shown a modification of the lower portion of the apparatus supporting the anvil 146. A pair of stationary blocks 160 and 162 are mounted on respective sides of the front face of the frame 45 and block 164 is pivotally mounted on pins 166 and 168 secured by set screws 167 and 169 in the respective blocks 160 and 162. The anvil 146 and shaft 148 as well as the slide fastener guide 154 are mounted on the pivotal block 164 so that the anvil 146 and guide 154 can be tilted forward and downward to aid in the positioning of a garment or slide fastener on the anvil 146. Additionally an abutment 172 is mounted on the pivotal block 164 with a switch 170 mounted on the frame 45 behind the pivoted block 164 on the frame 45 for being engaged by the abutment 172. When an operator has positioned a slide fastener on the anvil 146 and returns the pivoted block 164 to its raised position, the abutment 172 actuates the switch 170 which begins the operation to attach the staple to the slide fastener.

Figure 14:
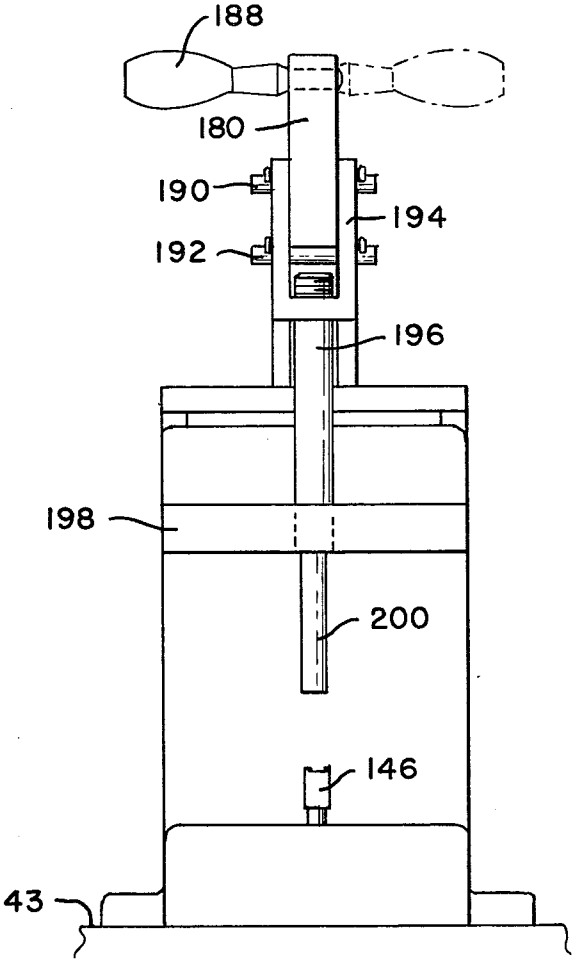
FIG. 14 is a front view of the apparatus of FIG. 13.
Figure 13:
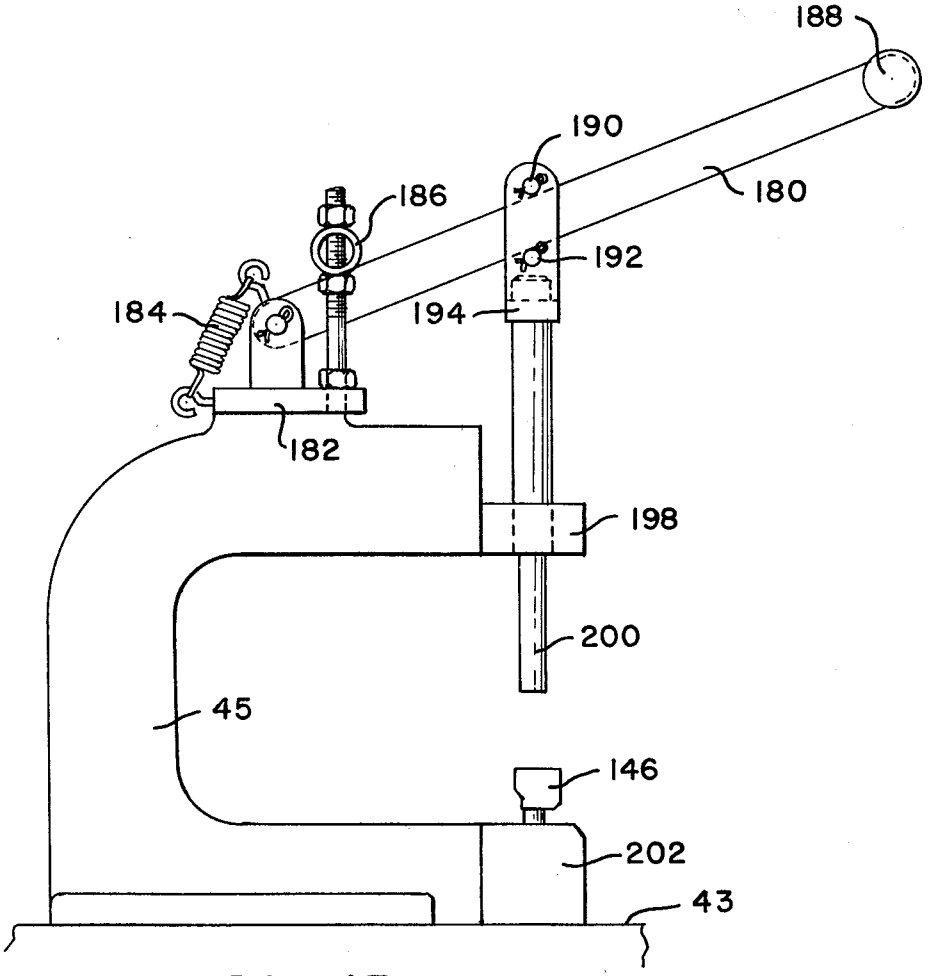
FIG. 13 is a side view taken from the left side of an apparatus for manually installing staple-like bottom stops on a slide fastener.

A manually operated staple fastening apparatus is illustrated in FIGS. 13 and 14 and includes a lever 180 which is pivotally mounted at its lower end on a bracket 182 secured to the top of the frame 45. A spring 184 is secured between extensions of the bracket 180 and the lever 182 so as to bias the lever 180 to a raised position against a stop member 186. A handle 188 is attached to the upper end of the lever 180; as shown in FIG. 14 the handle can be attached to extend to either side of the lever 180 so that the handle may be grasped by either the right or the left hand. A pair of pins 190 and 192 mounted in a clevis 194 extend above and below the lever 180. The clevis 194 is mounted on the top of the shaft 196 which is slidably mounted within a block 198 secured to the front face of the upper portion of the casting 45. A punch 200 is mounted in the lower end of the shaft 196 disposed over the anvil 146 which is mounted in a block 202 attached to the front face of the lower portion of the frame 45.

In operation of the hand operated staple securing apparatus, a garment or slide fastener is positioned over the anvil 146 and a staple is manually placed in position with the prongs penetrating into the slide fastener tapes. Then the lever 180 is moved downward by the operator grabbing the handle 188 and pulling the lever 180 downward to engage the punch 200 with the top of the staple and crimp the prongs of the staple to secure the staple to the slide fastener.

Since the present invention is subject to many modifications, variations, and changes in detail, it is intended that all matter in the foregoing description or shown in the accompanying drawings be interpreted as illustrative and not in a limiting sense.

What is claimed is:

1. An apparatus for applying bottom stops having upper wing portions and downward extending prongs to a slide fastener comprising a support, a split carrier having carrier halves and a central vertical opening formed between the carrier halves, shaft means mounting the split carrier on the support for allowing sliding movement of the carrier upward and downward, spring means biasing the carrier to a raised position, a gravity chute having channel means for feeding the bottom stops sequentially to the carrier at the raised position, said carrier halves having respective extending portions projecting horizontally to an outlet of the chute with upper surfaces of the extending portions aligned with the channel means, said carrier having downward converging camming surfaces at the top edges of the opening at the upper surfaces of the extending portions in the respective carrier halves for seating the respective upper wing portions of a bottom stop, means biasing the carrier halves together with a force greater than outward forces generated by the wing portions of a bottom stop on the camming surfaces of the carrier halves resulting from the upward bias of the carrier, a ram aligned with the central opening in the carrier, an anvil mounted on the support beneath the carrier and the ram and having means for crimping the prongs of the bottom stop, means mounting the ram on the support for moving the ram upward and downward such that during downward movement the ram engages the top of the bottom stop, moves the bottom stop and the carrier simultaneously down to a slide fastener positioned on the anvil, pushes the bottom stop between the carrier halves, and forces the prongs of the bottom stop through the slide fastener and against the crimping means of the anvil to crimp the prongs and secure the bottom stop to the slide fastener, and said carrier halves have respective inner vertical surfaces extending downward from the camming surfaces for guiding the bottom stops until engagement with slide fasteners and have respective inner diverging surfaces extending downward from the vertical surfaces.

2. An apparatus as claimed in claim 1 wherein the feeding means includes dispensing means having a hopper and a barrel member enclosing one side of the hopper, a rotatable shaft upon which the barrel member is mounted, a gear member also mounted on the shaft, a pawl pivotally mounted on the ram moving means for moving upward and downward therewith, means for biasing the pawl against the gear, means mounted on the support for engaging the pawl to force the pawl out of engagement with the gear during an end portion of the movement of the ram moving means whereby the gear and barrel member are spun, the spinning continuing after the movement of the ram has stopped, and said dispensing means including channel means responsive to rotation of the barrel member for receiving the bottom stops and directing them to the chute.

3. An apparatus as claimed in claim 2 wherein the barrel member has an inside frustro-conical surface opening toward the channel means, and has a plurality of radial grooves in the inside surface for moving the bottom steps by centrifugal force into the channel means.

4. An apparatus as claimed in claim 3 wherein the grooves are arranged in pairs for receiving the prongs of the bottom stops.

5. A method of applying a bottom stop with upper wing portions and downward extending prongs to a slide fastener comprising the steps of biasing a split carrier upward by means of a spring, feeding a bottom stop to the upwardly biased split carrier so that the wing portions of the bottom stop are seated against downwardly converging camming surfaces formed on inner edges of respective carrier halves of the split carrier, moving a ram downward into engagement with the top of the bottom stop, biasing the carrier halves together with a force greater than the outward camming force generated by the wing portions of the bottom stop on the camming surfaces of the carrier halves resulting from the upward bias of the split carrier, continuing downward movement of the ram to move both the bottom stop and the split carrier downward against the upward bias of the split carrier to just above the slide fastener, stopping the movement of the split carrier at the slide fastener.

further continuing downward movement of the ram to move the bottom stop downward forcing the carrier halves apart, guiding the bottom stop during said further continuing downward movement of the ram between inner vertical surfaces of the respective carrier halves after passing the camming surfaces and until engagement of the prongs with the slide fastener, crimping the prongs by anvil means during said further continuing downward movement between downwardly diverging relieved inner surfaces of the respective carrier halves permitting free bending of the bottom stop without engagement with the carrier halves, raising the ram to disengage the bottom stop, and returning the split carrier to its raised position by means of the upward spring bias.

6. A method as claimed in claim 5 wherein the feeding step includes the steps of engaging a pawl with a gear mounted on a rotatable barrel, moving the pawl rapidly to rotate the barrel, disengaging the pawl from the gear during the moving of the pawl to permit continued free rotation of the barrel, and directing the bottom stops from the barrel to chute means leading downward to the carrier.

7. A method as clamed in claim 6 wherein the directing step including centrifugally discharging the bottom stops from an inner outwardly flared frusto-conical surface of the barrel into channel means directed to the chute means.

* * * * *